United States Patent [19]

Hayfield

[11] Patent Number: 4,515,673

[45] Date of Patent: May 7, 1985

[54] ELECTRODE WITH ANODE ACTIVE LAYER

[75] Inventor: Peter C. S. Hayfield, Church Garth, England

[73] Assignee: Marston Palmer Limited, Wolverhampton, England

[21] Appl. No.: 540,856

[22] Filed: Oct. 11, 1983

[30] Foreign Application Priority Data

Oct. 29, 1982 [GB] United Kingdom ..... 8231029
Jun. 21, 1983 [GB] United Kingdom ..... 8316808

[51] Int. Cl.[3] ..... C25B 11/00

[52] U.S. Cl. ..... 204/290 F; 204/189; 427/125; 427/126.5; 502/101

[58] Field of Search ..... 204/290 F, 289, 290 L; 502/101; 427/125, 126.5

[56] References Cited

U.S. PATENT DOCUMENTS 3,443,055 5/1969 Gwynn ..... 204/290 F
3,540,994 11/1970 Napier ..... 204/289
3,547,600 12/1970 Gwynn ..... 204/290 F
3,711,397 1/1973 Martinsons ..... 204/290 F

*Primary Examiner*—John F. Niebling
*Attorney, Agent, or Firm*—Cushman, Darby & Cushman

[57] ABSTRACT

A titanium or niobium electrode substrate (which may be copper or steel cored) having on its surface a painted and fired anodically active layer for example of a platinum group metal, there being an interlayer of tantalum or an alloy containing more than 50% tantalum in metallic form between the anodically active layer and the substrate. The tantalum metal gives enhanced corrosion resistance and acid undermining resistance to titanium substrates and eases the manufacture of painted and fired niobium substrate electrodes.

The electrode may be an elongate rod having longitudinally extending protuberances along the length of the rod and around the circumference, the spacing and height of the protuberances being such that a straight line connecting the peaks of two adjacent protuberances does not intersect with the body of the electrode so that the protuberances protect the anodically active coating from damage during installation and operation of the electrode.

12 Claims, 1 Drawing Figure

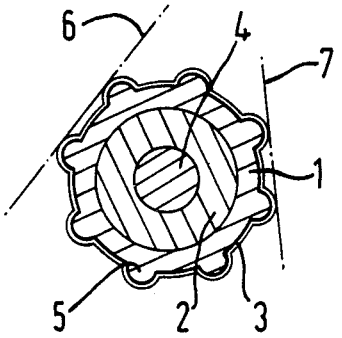
6
4
7
1
5
2
3

ELECTRODE WITH ANODE ACTIVE LAYER

BACKGROUND OF THE INVENTION

This invention relates to electrodes and has particular reference to electrodes for use in electrochemical applications. An electrochemical application is one in which the electrode is inserted into an electrolyte and acts to conduct electrical current from the electrode into the electrolyte. In most cases the electrode would act as an anode.

Electrodes are well known in the form of a metal substrate of a film-forming metal, normally chosen from the group titanium and niobium, with an outer layer of an anodically active material which is normally a material containing a platinum group metal or a platinum group metal oxide. The platinum group metals or oxides may be used on their own or in conjunction with other materials which may be regarded as diluents or carriers.

There are many methods of applying the platinum group metals or metal oxides forming the anodically active layer to the film-forming metal substrate, some of which involve the application of heat to the coated substrate with the coated substrate being heated in an oxygen-containing atmosphere such as air. Other methods of application do not require heating in an oxygen-containing atmosphere. Such other methods include electroplating, metallurgical bonding by rolling or co-extrusion or application techniques which involve heating in a vacuum such as ion plating.

The present invention is particularly concerned with application methods which involve the heating of the anodically active layer either in its final form or in its compound form in an oxygen-containing atmosphere.

In British Patent Specification No. 1 274 242 there is described an electrode construction in which a substrate of titanium or niobium has bonded to it a metal foil chosen from the group tantalum and niobium (tantalum only in the case of a niobium substrate) with an outer layer of a platinum group metal foil. The outer platinum group metal foil is bonded directly to the substrate by local electrically generated heat. Such a prior specification does not describe the use of a painted and fired platinum group metal layer.

In European Patent Application Publication No. 0 052 986 there is described the use of an interlayer of an oxide of a metal chosen from the group titanium, tantalum, zirconium, hafnium and niobium in which the oxide layer is partially reduced to form a sub-oxide, which sub-oxide acts as an intermediate coating between the substrate titanium and the anodically active materials. Such a prior specification does not describe the coating of niobium nor does it describe the use of a metallic interlayer between the substrate and the anodically active layer.

By "anodically active" as is used herein is meant a material which will pass significant electrical current when connected as an anode without passivating or without dissolving to any significant extent. Such an anodically active layer is the basis of a dimensionally stable anode in which the anode passes a current without significantly changing during the passage of the current.

SUMMARY OF THE INVENTION

By the present invention there is provided an electrode comprising a metal substrate of a metal chosen from the group titanium and niobium with an anodically active layer, the anodically active layer having been produced by heating in an oxidising atmosphere at temperatures in excess of 350° C., there being provided a layer of tantalum or an alloy containing more than 50% of tantalum in metallic form between the anodically active layer and the substrate.

The anodically active layer may contain a platinum group metal or platinum group metal oxide or an anodically active spinel having the general formula $X^{2+}Y_2^{3+}O_4$. The spinel may be a cobalt based spinel of the general formula $M_xCo_{3-x}O_4$ where M is a metal chosen from the group copper, magnesium, or zinc. The spinel may include a zirconium oxide modifier and may have the general formula $Zn_xCo_{3-x}O_4.YZrO_2$ where O Y 1. The coatings may be prepared by thermal decomposition of a paint in which the cobalt is dissolved as cobalt nitrate and the paint is stoved in the temperature range 250° C. to 475° C.

Single metal spinels may be used such as $Fe_3O_4(Fe^{2+}Fe_2^{3+}O_4)$ and $Co_3O_4$. Alternatively the anodically active layer may be manganese dioxide or $TiO_x$ where x is in the region 0.6 to 1.9, preferably in the region 1.5 to 1.9 and further preferably in the region 1.7 to 1.8.

The anodically active layer preferably contains platinum and iridium. Preferably the anodically active layer contains 70% platinum 30% iridium (all percentages being weight percent of metal). Some or all of the iridium may be present as iridium oxide.

A preferred form of electrode comprises a niobium substrate having a platinum and iridium containing coating as the anodically active layer with a thin layer of tantalum in metallic form interposed between the niobium and the platinum and iridium containing layer. By a thin layer is meant a layer having a thickness in the region of a few microns up to a few millimeters. Preferably the tantalum layer is metallurgically bonded to the substrate metal. Metallurgically bonded tantalum may have a thickness in the region 0.1 to 2.5 mm, preferably 1 to 2.5 mm. The metallurgical bond may have been formed by rolling, co-extrusion, or a diffusion bonding technique or by any other suitable technique.

The electrode may have a series of longitudinally extending protuberances along the length of the rod and around the circumference, there being provided the anodically active coating on the surface of the rod within some at least of the regions between the protuberances, there being provided between five and twenty protuberances, the spacing and height of the protuberances being such that a straight line connecting the peaks of two adjacent protuberances does not intersect with the body of the electrode between the protuberances.

The present invention also provides a method of manufacturing an electrode comprising forming on a metal substrate of a metal chosen from the group titanium and niobium a layer of tantalum or an alloy containing more than 50% of tantalum in metallic form and applying to the tantalum layer a compound containing at least one platinum group metal, heating the compound and substrate in an oxidising atmosphere at temperatures in excess of 350° C. for a time sufficient to decompose the compound to form a platinum group metal or platinum group metal oxide.

Preferably the heating takes place at a temperature in the range 350° C. to 850° C., or 400° C. to 650° C., preferably further in the range 400° C. to 550° C.

The tantalum layer may be applied to the metal substrate by an extrusion technique in which a billet of titanium or niobium is covered with a layer of tantalum and the billet is subsequently extruded at elevated temperatures to metallurgically bond the tantalum to the niobium or titanium. Alternatively the tantalum may be applied to the substrate metal by a co-rolling technique. A copper lubricant may be used on the exterior of the tantalum during the co-extrusion or rolling.

The metal substrate may be provided with a core of a metal having a higher electrical conductivity, such as copper or aluminum. Steel may be incorporated into the interior of the structure to give increased strength. Alternatively the tantalum sheathed niobium or titanium can be fabricated in the form of tube as well as of solid metal.

The present invention further provides an electrode when manufactured by a process as set out above.

There is further provided a method of use of an electrode of the type set out above which comprises the steps of inserting the electrode as an anode into an electrolyte and passing an electrical current into the electrolyte from the anode. The anode may be operating as a cathodic protection anode to cathodically protect a steel or iron-containing structure. The anode may be used in ground beds for protecting buried structures such as pipelines, tanks and oil and water well casings. Such ground beds can be of the shallow or deep type, and both openhole and backfilled. The anode material is particularly suitable for use in deep well openhole ground beds. The anode can be advantageously used for protecting the bore of water wells in addition to the exterior surface. The anode may be used in electrolytic cells, such as electrodialysis cells for the production of potable water from brackish water.

The term platinum group metals as used herein is intended to cover metals or oxides thereof chosen from the group platinum, iridium, osmium, ruthenium, rhodium and palladium.

BRIEF DESCRIPTION OF THE DRAWING

By way of example embodiments of the present invention will now be described with reference to the accompanying drawing which shows a cross-section of an elongate anode.

DESCRIPTION OF THE PREFERRED EMBODIMENTS

The cathodic protection industry essentially uses two types of anodes. The first type is the so-called consumable or sacrificial type, such as magnesium, zinc, aluminium or their alloys, and these are consumed to protect the structure of steel. In the second type of system, the so-called impressed current system, a permanent anode is used and the anode is provided with a source of electrical current to enable the steel structure to be cathodically protected. Conventionally the anodes for cathodic protection have been formed from platinised titanium. It is well known that titanium, when connected as an anode in seawater, will form a protective oxide film. However, as the applied voltage at the anode increases, there reaches a stage where the anodic film breaks down. It is generally accepted that the breakdown voltage for titanium in seawater is about 9 to 10 v. By comparison the breakdown voltage for niobium, which also forms an anodically passive oxide film, is about 100 v. The breakdown voltage for tantalum is similar to that of niobium.

Unfortunately, however, niobium is some twenty times more expensive than titanium, and tantalum is some two to four times more expensive than niobium. There is, therefore, a considerable financial incentive to use titanium wherever possible and, if the use of titanium is not possible, to use niobium rather than tantalum.

Although niobium has a higher breakdown voltage than titanium, it does oxidise more readily in air. The present invention is partially the result of the observation that the electrocatalytic activity of the platinum group metal containing coating applied to permanent cathodic protection anodes depends on its composition and this is partially controlled by the method of application. There is a small but finite corrosion rate of the platinum group metal applied to cathodic protection anodes and it has now been observed that painted and fired platinum-iridium type coatings have a wear rate which is less than half that of an electroplated platinum or platinum-iridium coating. This is not only the case in normal seawater containing approximately 30 g/l sodium chloride but is especially so in very dilute seawater which is sometimes known as brackish water and contains a few grams per liter of sodium chloride and other dissolved salts. Brackish water is often found in open hole deep well ground bed anodes of the type used in the oil industry and in connection with the cathodic protection of pipelines.

Unfortunately, however, it is extremely difficult to coat niobium with a painted and fired coating because the metal oxidises readily in air at temperatures above 350° C. As a result the controls needed to manufacture painted and fired niobium anodes have proved prohibitively expensive.

It has now been discovered that by the application of a tantalum metal interlayer to a niobium substrate a painted and fired platinum-iridium coating can be applied which is easy to make, strongly adherent and permits the anode to behave as though it were a conventional niobium anode but for very much less than the cost of a tantalum anode.

The anode is manufactured by co-extruding a billet of niobium with a tantalum sheath at temperatures typically in the range 800° C. to 1000° C. Thus a niobium billet of 10 cm diameter and 30 cm in length is covered by a tantalum sheath of ½ cm thickness, the assembly in inserted into a copper can, evacuated and sealed. The sealed assembly is then heated to a temperature of 900° C. and co-extruded. The copper is then pickled away to reveal a tantalum coated niobium wire. If required the niobium billet can be provided with a copper core to enable the production of tantalum coated copper cored niobium wire. This wire may then be shot blasted with a slurry of aluminium oxide in water and subsequently coated with a platinum-iridium compound containing paint and then fired in air at 500° C. for a time in the region of one to 24 hours. Two or more platinum-iridium coats can be applied to develop a thickness of platinum-iridium anodically active coating to any desired level.

If it is required to produce flat anodes, as opposed to anodes in rod or wire form, the tantalum layer may be applied to the niobium substrate by a roll bonding technique. Thus a sheet of niobium is covered with a sheet of tantalum, the assembly wrapped with a copper sheath, evacuated and sealed and the sheathed sandwich is then rolled at an elevated temperature to bond the niobium to the tantalum.

The tantalum may alternatively be bonded to the niobium by an explosion bonding technique.

Even if in use the tantalum layer became breached it would only expose a niobium or titanium substrate which would be resistant to further breakdown.

The technique may be used to uprate the performance of titanium electrodes. Thus a titanium substrate could be coated with a tantalum layer by any of the techniques set out above, i.e. roll bonding, co-extrusion, ion plating or explosive bonding, and the tantalum metal would then be coated with a painted and fired platinum group metal containing an anodically active layer such as a 70/30 platinium-iridium alloy. Some or all of the iridium may be present as an oxide.

It has been found that each of the components of the electrodes of the invention has an important part to play in satisfactory operation of the invention.

Considering first the external platinum metal layer, tests have been carried out to determine the wear rate of various platinum metals when immersed in a dilute chloride solution which is highly acidic, i.e. at pH 1. It has unexpectedly been found that extremely significant differences in wear rate can occur with different forms of the platinum coatings. Thus when platinum metal foil is used as an anode material at a current density of 430 $A/m^2$ in a solution containing 2 parts $SO_4^{--}$ and 1 part $Cl^-$ at a pH of 1 and at a chloride concentration of 3 g/l the wear rate is 46 micrograms/A hour. At a current density of 1 076 $A/m^2$ the wear rate is 31.2 micrograms/A hour. Simple platinum plated niobium has a wear rate of 44.9 micrograms/A hour at a current density of 430 $A/m^2$. Co-extruded platinum layers on a niobium core have wear rates of 20 micrograms/A hour. Platinum electroplated titanium has a wear rate of 37.4 micrograms/A hour at a current density of 430 $A/m^2$. However, a fired platinum/iridium layer on a tantalum sheathed titanium substrate has a wear rate of only 7.7 micrograms/A hour at a current density of 430 $A/m^2$. It can be seen that this is a very significant reduction in wear rate compared to the wear rate of other types of coated anodes and platinum metal itself.

The tantalum interlayer is of extreme importance in the manufacture of niobium cored fired platinum group metal surfaces. Because of the tendency of niobium to oxidise in air at temperatures of above 350° C. the production of fired coatings on niobium is extremely difficult and the use of a tantalum interlayer enables fired coatings easily to be manufactured.

When considering the inner layer as being titanium the tantalum has a number of functions. Thus tests were made on a three layer material comprising a core of titanium, an intermediate layer of tantalum and an outer layer of fired platinum metal. When such a material having a surface area of 10 $cm^2$ was polarised in 3% sodium chloride at room temperature a current of 0.9 A was passed at a voltage of 7 v. In order that the voltage could be significantly increased further tests were subsequently carried out with a 30 fold dilution of the 3% sodium chloride solution again at room temperature. The applied voltage and the measured current are given in Table I below.

TABLE I

| Volts | Current (A) |
|---|---|
| 5 | 0.07 |
| 10 | 0.27 |
| 15 | 0.48 |
| 20 | 0.72 |

TABLE I-continued

| Volts | Current (A) |
|---|---|
| 25 | 1.00 |

To simulate damage to the electrode a cut was made through the surface to expose the titanium substrate. The sample was then re-polarised in the same dilute sodium chloride solution. Again measurements were made of voltage and current and the information is presented in Table II below.

TABLE II

| Volts | Current (A) |
|---|---|
| 5 | 0.07 |
| 10 | 0.29 |
| 12 | 0.38 |
| 14 | 0.47 |
| 16 | 0.59 |
| 18 | 0.68 |
| 20 | 0.78 |
| 22 | 0.88 |
| 24 | 0.98 |

It can be seen, therefore, that there is no difference, within the limits of experimental error, on the current passed at high voltages with damaged and undamaged material. It is important to note that the titanium does not dissolve and becomes covered with an anodically passive oxide film. Were the core of the tantalum to be formed of copper the core would simply dissolve under these conditions and the anode would collapse. The presence of the tantalum sheath on the titanium has a great deal of importance at the end of life of the anode. Thus when the anode reaches the end of its life, and the platinum is virtually removed, large areas of tantalum are exposed. These tantalum areas are capable of withstanding high voltages without anodic breakdown and thus the passivated anode may simply be removed for re-coating and re-use. In the absence of the tantalum layer the high voltages developed over the titanium substrate would cause anodic breakdown of the titanium if the voltages exceeded above 10 v.

The high resistance to acid undermining of the tantalum layer also tends to prevent undermining of the platinum coating which, in the case of fired coatings, tends to have a micro cracked form with areas partially lifted from the substrate. In the absence of the tantalum layer acid undermining of the titanium could occur and this could cause detachment of large segments of the platinum.

Although it is not necessary to provide the intermediate metallic coating on titanium to prevent thermal oxidation during the heating stage, it has been found that the use of the intermediate layer increases the durability of the electrode in use. Thus an electrowinning anode comprising a titanium substrate having an electroplated platinum layer to which a painted and fired platinum-iridium layer was applied by thermal decomposition, gave excellent results in practice. If required the electroplated layer may be applied to a previously applied thermally decomposed layer as is described, for example, in UK patent specification No. 1 351 741.

Details of suitable cobalt spinel based chlorine anodes can be found in the publication Comprehensive Treatise of Electrochemistry edited by Bockris, Conway, Yeager and White, Chapter 2, Production of Chlorine by Donald L. Caldwell, pages 105 to 166, particularly pages 126 and 127. Furthermore the anodically active coating may be a ferrite material formed by combining $Fe_2O_3$ with one of the divalent metal oxides such as MnO, NiO, CoO, MgO and ZnO.

One form of elongate anode in accordance with the present invention comprises a sheath 1 of titanium having a copper core 2 and an anodically active layer 3. A steel reinforcing rod 4 is located within the copper core. The anode is manufactured by forming a composite structure comprising a copper tube with an inner steel core and an outer layer of titanium with a tantalum external sheath. The composite structure is heated and extruded to form a rod of substantially circular cross-section. The rod has an outer layer of tantalum covering an inner layer of titanium on a copper core with a steel rod through the centre of the copper core. The circular corss-section rod is then drawn to final size through a series of finishing dies which form the external surface of the rod into the shape illustrated in the drawing. By this means there is formed the eight protuberances 5. The elongate rod is then painted with a suitable platinum and iridium containing paint and fired to give the structure shown in the drawing. It can be seen that a line such as line 6 or line 7 interconnecting the peaks of the protuberances which are adjacent to one another does not intersect with the main body of the titanium sheath 2. Thus if the elongate structure happens to be pulled across a metal surface only the peaks of the protuberances will be scraped and the main portion of the coating will be undamaged.

In addition to the use of the electrodes in cathodic protection the electrodes may be used in elctrowinning, electroplating, hypochlorite production, chlorate production or any other required electrochemical use.

I claim:

1. An electrode comprising a metal substrate of a metal chosen from the group titanium and niobium with an anodically active layer, the anodically active layer having been produced by heating in an oxidising atmosphere at temperatures in excess of 350° C., there being provided a layer of tantalum or an alloy containing more than 50% of tantalum in metallic form between the anodically active layer and the substrate.

2. An electrode as claimed in claim 1 in which the anodically active layer contains a platinum group metal or a platinum group metal oxide.

3. An electrode as claimed in claim 1 in which the anodically active layer is chosen from the group: a spinel having the general formula $X^{2+}Y_2{}^{3+}O_4$ where X is a bivalent metal and Y is a trivalent metal; a cobalt based spinel of the general formula $M_xCo_{(3-x)}O_4$ where M is a metal chosen from the group copper, magnesium or zinc; manganese dioxide or $TiO_x$ where x is in the region 1.5 to 1.9.

4. An electrode as claimed in claim 2 in which the anodically active layer contains platinum and iridium.

5. An electrode as claimed in claim 4 in which some or all of the iridium is present as iridium oxide.

6. An electrode as claimed in claim 5 in which the electrode comprises a niobium substrate having a platinum and iridium containing coating as the anodically active layer with a thin layer of tantalum in metallic form interposed between the niobium and the platinum and iridium containing layer and metallurgically bonded to the niobium.

7. A method of manufacturing an electrode comprising forming on a metal substrate of a metal chosen from the group titanium and niobium a layer of tantalum or an alloy containing more than 50% of tantalum in metallic form and applying to the tantalum layer a compound which on deposition forms an anodically active layer, heating the compound and substrate in an oxidising atmosphere at temperatures in excess of 350° C. for a time sufficient to decompose the compound to form the layer of anodically active material.

8. A method as claimed in claim 7 in which the anodically active layer contains a platinum group metal or platinum group metal oxide, and in which the compound contains at least one platinum group metal.

9. A method as claimed in claim 8 in which the heating takes place at a temperature in the range 350° C. to 850° C., or 400° C. to 650° C., preferably further in the range 400° C. to 550° C.

10. A method as claimed in claim 9 in which the tantalum layer is applied to the metal substrate by an extrusion technique in which a billet of titanium or niobium is covered with a layer of tantalum and the billet is subsequently extruded at elevated temperatures to metallurgically bond the tantalum to the niobium or titanium.

11. An electrode as claimed in claim 1 in which the electrode is in the form of an elongate rod having a series of longitudinally extending protuberances along the length of the rod and around the circumference, there being provided the anodically active coating on the surface of the rod within some at least of the regions between the proturberances, there being provided between five and twenty protuberances, the spacing and height of the protuberances being such that a straight line connecting the peaks of two adjacent protuberances does not intersect with the body of the electrode between the protuberances.

12. An electrode as claimed in claim 11 in which there are eight protuberances.

* * * * *